United States Patent [19]

Brown, Jr.

[11] 4,193,652

[45] Mar. 18, 1980

[54] CARPET SAMPLE DISPLAY CASE

[76] Inventor: Joseph E. Brown, Jr., Little Rock, Pulaski, Ark. 72202

[21] Appl. No.: 867,187

[22] Filed: Jan. 4, 1978

[51] Int. Cl.[2] ..... A47B 81/00; A47B 97/00

[52] U.S. Cl. ..... 312/280; 206/555; 206/561; 211/45; 220/73; 229/15; 229/37 E

[58] Field of Search ..... 312/280, 253, 118, 9, 312/10, 193; 206/561, 555, 556; 211/10, 11, 45, 50, 183, 126; 229/15, 37 E; 220/73

[56] References Cited

U.S. PATENT DOCUMENTS

| | | | |
|---|---|---|---|
| 1,066,018 | 7/1913 | Kehoe | 220/73 |
| 2,110,556 | 3/1938 | Scheinman et al. | 229/37 E |
| 3,049,225 | 8/1962 | Fancher | 206/561 |
| 3,185,423 | 5/1965 | Jones | 312/254 |
| 3,659,774 | 5/1972 | Mielke | 220/73 |

*Primary Examiner*—Mervin Stein
*Assistant Examiner*—Alexander Grosz
*Attorney, Agent, or Firm*—Cushman, Darby & Cushman

[57] ABSTRACT

An upwardly open, transversally partitioned box is preferably made of exteriorly decorated corrugated paper box board. The upper and lower box edges are protected and reinforced with square hoop-like metal frames, riveted in place. The dividers are hung from upper edge metal frames, riveted at opposite ends to opposed sides of the box upper edge reinforcing frame. The case may be free-standing or pedestal-supported, e.g., upon a similar case turned on its side or upon a vertical axis cruciform support. Carpet samples stowed in the individual upwardly open cells defined between the box sides and partitions are individually accessible.

17 Claims, 9 Drawing Figures

CARPET SAMPLE DISPLAY CASE

BACKGROUND OF THE INVENTION

The most popular carpet display rack used currently is what is called the "waterfall." Typically, as illustrated in the U.S. design patent of Best, U.S. Pat. No. Des. 212,136, issued Aug. 27, 1968, the carpet samples are bolted to the rack so they are not individually accessible. The samples below the top three or four are difficult to get at for viewing. The pile on those near the bottom tends to become crushed and unappealing. Thus, structural disabilities inherent in the waterfall display system make sales based on some carpet samples inherently less probable than sales based on others, irrespective of quality, price and availability of the carpeting. Just as it is difficult for consumers to effectively browse to the bottom of a waterfall display of carpet samples, it is difficult for the sellers maintaining the displays to delete and insert samples therefrom and thereinto. In general, a waterfall display rack is limited to accommodating samples of a single size.

Other prior art display racks are shown in the following prior U.S. patents:

| Patentee | U.S. Pat. No. | Issue Date |
|---|---|---|
| Jennings | 3,633,759 | January 11, 1972 |
| Schouten | Des. 243,577 | March 8, 1977 |

Of course, other plate-like products or samples traditionally and frequently are displayed in upwardly open, transversally partitioned racks. Examples of such plate-like products incude phonograph records, magazines, library index cards, and art prints for framing.

SUMMARY OF THE INVENTION

Breaking with the tradition of what is available for displaying carpet samples, the present invention provides an upwardly open, transversally partitioned box is preferably made of exteriorly decorated corrugated paper box board. The upper and lower box edges are protected and reinforced with square hoop-like metal frames, rivted in place. The dividers are hung from upper edge metal frames, riveted at opposite ends to opposed sides of the box upper edge reinforcing frame. The case may be free-standing or pedestal-supported, e.g., upon a similar case turned on its side or upon a vertical axis cruciform support. Carpet samples stowed in the individual upwardly open cells defined between the box sides and partitions are individually accessible.

Thus, with the system of the invention, each carpet sample is approximately equally accessible, and attractively presented. Each sample can be withdrawn individually pulled-up further or even withdrawn totally from the display by the prospective purchaser. Likewise, samples may be individually abstracted, collated with others to be presented for a tentative selection or pairing incident to making a sale, and obsolete, out-of-stock, worn or otherwise undesired samples may be withdrawn and others added.

Further, the customer can make a "fingertip review" of the displayed samples, by flexing the exposed upper portions of the samples slightly until one is reached that the customer wants to review in detail. Then, nothing but that sample needs to be lifted in order to abstract that sample from the display.

For use with the system of the invention, the carpet samples need no modification; no hooks, eyes, ribs, lips or other attachments or additions to the samples are needed.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENTS

Figure 1:
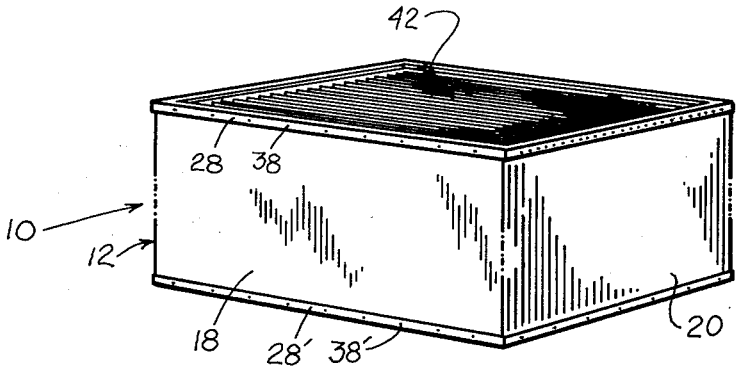
FIG. 1 is a perspective view of the carpet sample display case.
Figure 2:
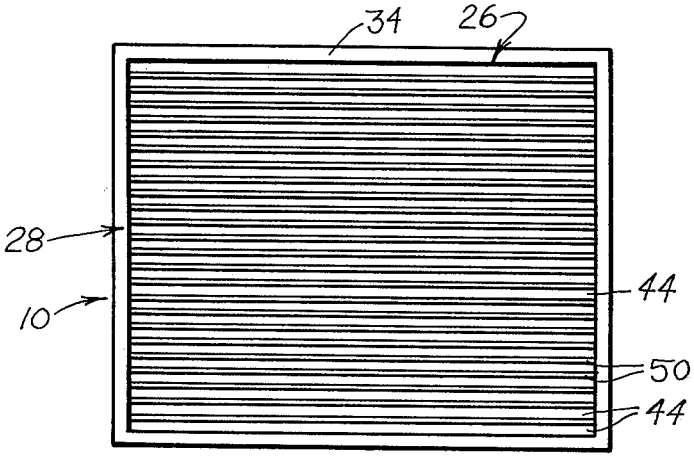
FIG. 2 is a top plan view thereof.
Figure 3:
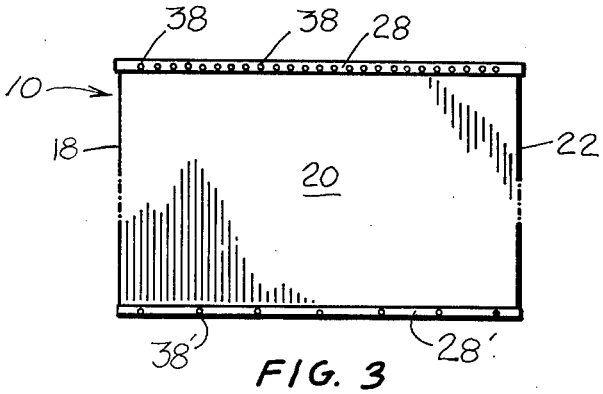
FIG. 3 is a right side elevation view thereof.

Referring to FIGS. 1–5, the carpet sample display case 10 is constituted by a body 12 having a rectangular floor 14 and four upstanding peripheral sidewalls 16, 18, 20, 22 in two opposed pairs 16, 20 and 18, 22. (For convenience walls 16, 20 will be called "sides" and walls 18, 22 will be called "front" and "back," respectively.)

Although the body 12 could be made of any material commonly used to make furniture or display cases, a convenient material for use is the sort of double-faced boxboard having a corrugated paper or foamed plastic resin core that is used as packaging in interstate transportation, as what is commonly called "cardboard boxes." Such material is currently commercially available with one face, ie., the exterior face decorated e.g. by being photolithographed with a simulated wood grain pattern. The body 12 has neither a top wall nor flaps such as a cardboard box has; instead, the walls 16–22 terminate in an upper edge 24 which provides a rectangularly figured, upwardly facing opening 26.

The display space 42, of which the opening 26 is the mouth, is divided into a front-to-back series of laterally wide, and vertically deep, but forwardly short upwardly open compartments or cells 44, by the front and back walls 18, 20, and by a plurality of dividers or partitions 46.

The partitions depend into the space 42 from the mouth 26, so that each is spaced from its two neighbors in the series. In the instance of the first partition, one neighbor is a front wall 18 and the other is the second partition and in the instance of the last partition, the one neighbor is the next-to-last partition and the other is the back wall 20.

Each partition 46 preferably also is made of the same material as or one similar to, the material used to make the body 12 walls, e.g., bi-faced, cored containerboard.

The perimeter of the opening 26 is reinforced with a fitting 28 of rectangular "hoop" figure. The fitting 28 may be made of lengths of metallic extrusion e.g., aluminum alloy, secured together at the corners.

Figure 4:
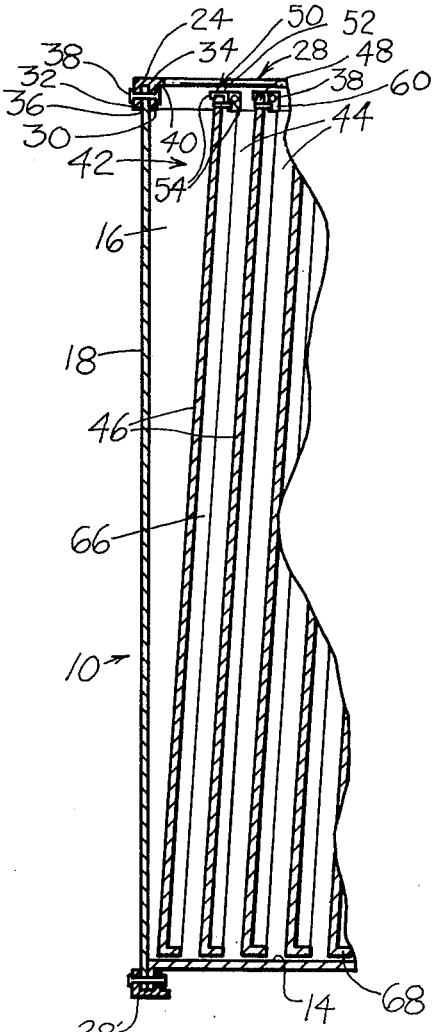
FIG. 4 is a fragmentary, larger scale cross-sectional view thereof.
Figure 5:
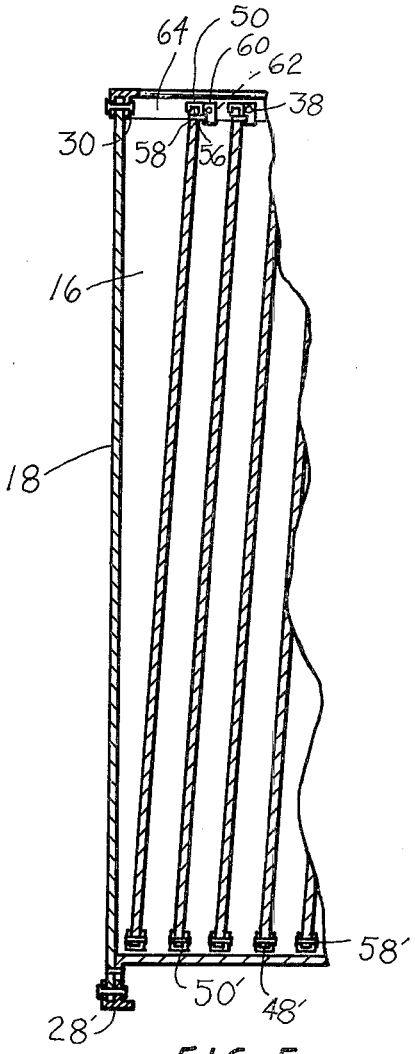
FIG. 5 is a fragmentary, larger scale cross-sectional view similar to FIG. 4, but of a variation.

Referring to FIGS. 4 and 5, the edge reinforcing fitting 28 has an inner and an outer, downwardly projecting flanges 30, 32 based upon a tranverse flange 34, so as to define a downwardly opening, perimetrically extending slot 36. The slot 36 snuggly receives the edge 24, so that the edge 24 is intercalated between the flanges 30, 32 about the whole perimeter of the opening 26.

The edge reinforcing fitting is firmly secured in place. In the preferred embodiments, the securement is accomplished with the use of fastners, in these instances tubular metal rivets 38.

Notice now, that the base flange 34 has a ledge portion 40 which extends inwardly beyond the flange 30.

A similar edge reinforcing fitting 28' preferably is secured to the body 12 at the perimeter of the floor 14. FIGS. 4 and 5 illustrate how that may be done. Other ways are possible.

Further, each partition has an upper edge 48 that is reinforced, e.g., by an inverted, U-shaped fitting 50 which has a base 52 and two depending legs 54. The edge is received in the slot 56 between the legs 54 and base 52. The fitting 52 may, for instance, be made of the same material as the fitting 28. Each fitting 50 is secured in place on the respective edge 48 and extends from end-to-end thereof. One way the fittings 50 may be secured on the edges 48 is by tubular rivets 58 secured thickness-wise through the respective partition and one or both legs 54. See FIG. 4. If needed or desired, (see FIG. 5) a similar reinforcement 50' may be similarly secured on the respective lower edges 48' of the partitions 46.

In the preferred embodiments, at each end of each fitting 50, an ear 60 is provided on the respective end of a respective fitting leg 54. Each ear 60 extends in a forwardly-rearwardly, vertical plane. The two ears 60, one at each end, for each partition 46 are just far enough apart, so that when put in position as shown, the respective laterally outer faces 62 of the ears 60 confrontingly engage the laterally inner faces 64 of the inner flanges 30 on the edge 24 on the side walls of the body 12. There, the ears 60 are secured to the fitting 28, for instance, again, by use of tubular rivets 38.

The reinforced partitions may be provided to have weight distributions that cause them to hang at a slight pitch, or substantially vertically. (See FIG. 4 and 5).

In FIG. 4, the vertical stiffness of the partitions has been augmented by bending strips 66 at their side edges to project rearwardly and a strip 68 at the bottom, bent to project rearwardly similarly provide stiffness. The strips 66 and 68 may be secured together at their mutual corners to maintain the shape shown.

Notice now, that the ledge 40 projects inwardly all the way around the mouth of the display space sufficiently to provide some protection for the ears 60 and for the rivets 38.

Figure 6:
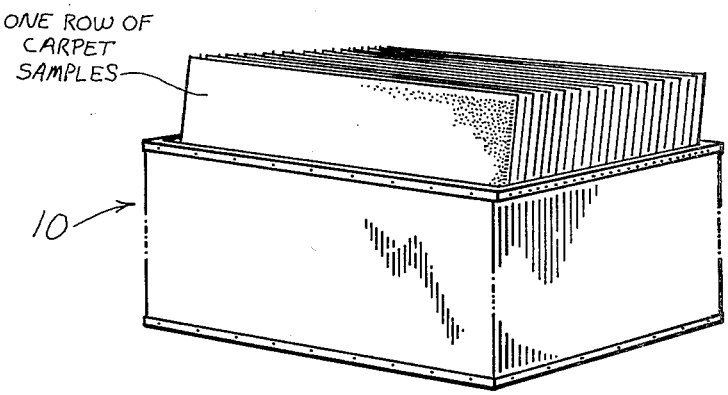
FIG. 6 is a perspective view of the carpet sample display case of FIG. 1 filled with a single row of carpet samples.
Figure 7:
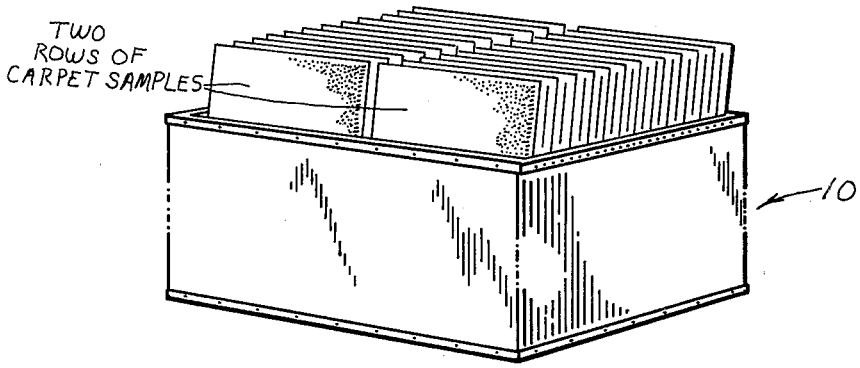
FIG. 7 is a perspective view of the carpet sample display case of FIG. 1 filled with two rows of carpet samples.

The carpet sample display case of FIG. 1–5 may be used as is, as a free-standing display, e.g. sitting on a selling floor at a carpet store, market, lessor's, or the like. Carpet samples may be slid down into the individual compartments or cells, for instance one carpet sample per cell, as shown in FIG. 6, or with two, side-by-side samples in each cell, as shown in FIG. 7.

Currently 27×18, inches, 27×36 inches, and 13½×18 inches are standard sizes for carpet samples. The height of the side walls of the body 12 thus may be made taller or shorter in various models of the case 10, for accommodating singles or pairs of rows of samples. Likewise, the number, thickness and width of partition cells may be varied to accommodate samples of varied dimensions, including pile height.

In each instance however, enough carpet sample (e.g., six inches or more) projects upwardly that the customer can "leaf" through the projections and early see if any samples are of enough interest to warrant their being pulled out for further viewing.

Figure 8:
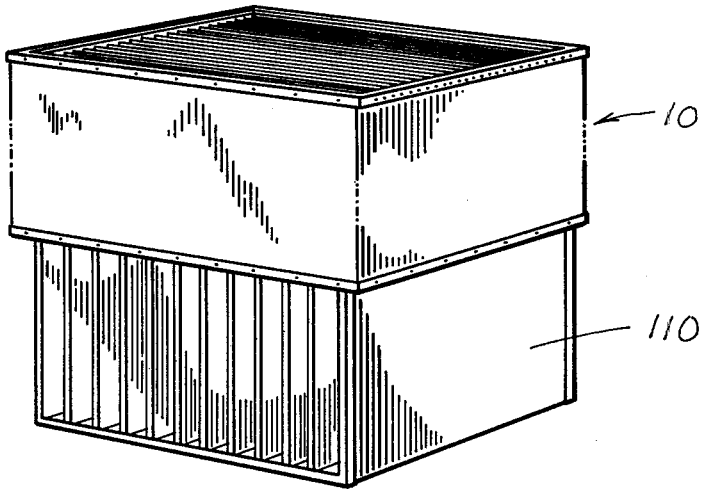
FIG. 8 is a perspective view of the carpet sample display case of FIG. 1, supported upon a carpet sample deck board storage case acting as a pedestal.
Figure 9:
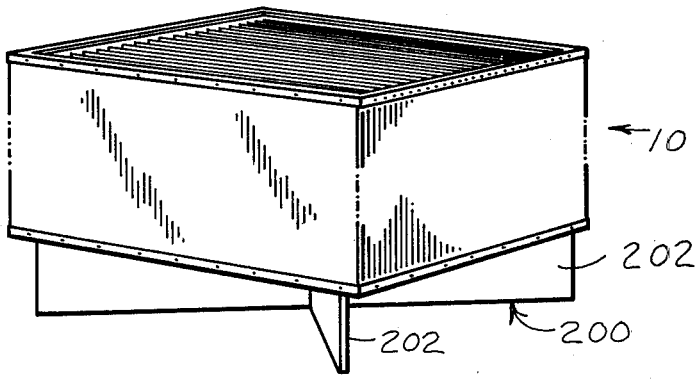
FIG. 9 is a perspective view of the carpet sample display case of FIG. 1, supported upon a vertical-axis cruciform pedestal.

The display case 10 need not sit directly on the floor; two variants of pedestal are shown in FIGS. 8 and 9.

In the variation shown in FIG. 8, the carpet sample display case 10 is supported upon a carpet sample deck board storage case 110. The case 110 may be substantially similar in construction, to the case 10, but set on one side wall.

In the variation shown in FIG. 9, the carpet sample display case 10 is supported upon a simple vertical axis cruciform pedestal 200, e.g., made of assembled, crossed webs 202 transversally half-slotted at their centers to accommoate one another, and made of the same cartonboard or, e.g., of particle board, plywood, or the like.

It should now be apparent that the carpet sample display case as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A carpet sample display case, comprising, a body that is substantially rectangular in plan, and includes four upstanding walls arranged in two opposed pairs consisting of a pair of opposed side walls, and a front wall paired with a back wall, that define an upwardly open display space among them;

said walls having an upper edge extending perimetrically of the body;

a rectangular rim of reinforcing material mounted upon said upper edge and extending perimetrically of the body;

means securing said reinforcing rim in place upon said upper edge;

a plurality of substantially parallel partitions arranged in a front-to-back series in said display space so as to, with said upstanding walls, divide said space into a front-to-back series of upwardly open compartments, each for receiving at least one carpet sample for projection upwardly therefrom for more casual inspection and for free withdrawal by upward sliding from the respective compartment for more particular inspection;

means securing each partition in place with respect to the body;

the reinforcing rim being a metal fitting, generally of constant transverse section except at four sites where four lengths thereof are joined at respective corners;

the fitting in transverse section having at least one leg in facial confrontation with said four upstanding walls at the upper edge thereof;

the fitting having a second leg in facial confrontation with said four upstanding walls at the upper edge thereof, in opposition to said one leg, said upper edge being received between said one leg and said second leg;

said means securing said reinforcing rim in place upon said upper edge comprising fasteners secured through the respective of said walls and both said legs; and the same said fasteners also proceeding through means defining ears at opposite ends of each of said partitions and thereby providing said means securing each partition in place.

2. The carpet sample display case of claim 1, wherein said fasteners are constituted by rivets.

3. The carpet sample display case of claim 1, wherein:

the upstanding walls are made of bi-faced, expanded core container board, decorated on the exterior faces thereof.

4. The carpet sample display case of claim 1, further comprising:

said body further having a generally rectangular floor perimetrically secured to the upstanding walls adjacent the lower edge of said upstanding walls.

5. The carpet sample display case of claim 4, further including:

a second rectangular rim of reinforcing material mounted upon said lower edge and extending perimetrically of the body; and means securing said second reinforcing rim in place upon said lower edge.

6. The carpet sample display case of claim 1, further comprising:

a second rectangular rim of reinforcing material mounted upon said lower edge and extending perimetrically of the body; and means securing said second reinforcing rim in place upon said lower edge.

7. The carpet sample display case of claim 6, wherein:

the second reinforcing rim is a metal fitting, generally of constant transverse section except at four sites where four respective lengths thereof are joined at respective corners;

the fitting, in transverse section, having at least one leg in facial confrontation with said four upstanding walls at the lower edge thereof.

8. The carpet sample display case of claim 7, wherein:

the fitting has a second leg in facial confrontation with said four upstanding walls at the lower edge thereof, in opposition to said one leg, said lower edge being received between said one leg and said second leg.

9. The carpet sample display case of claim 8, wherein:

said means securing said second reinforcing rim in place upon said lower edge comprises fasteners secured through the respective of said walls and both said legs.

10. The carpet sample display case of claim 9, wherein:

said fasteners are constituted by rivets.

11. The carpet sample display case of claim 1, further comprising:

an inverted, U-shaped in transverse section, flange of reinforcing material secured upon the upper edge of each respective partition and extending from end to end thereon;

each of said ears being provided at opposite ends of the respective ones of said inverted U-shaped flanges.

12. The carpet sample display case of claim 11, wherein:

the inverted, U-shaped flanges are made of metal and the partitions are made of bi-faced, expanded core container board.

13. The carpet sample display case of claim 1, further comprising:

a plurality of individual, rectangular carpet samples, removably deposited one to a cell, in each of a plurality of cells in said display space, each sample extending throughout substantially the full width and height of the respective cell and projecting upwardly substantially thereabove.

14. The carpet sample display case of claim 1, further comprising:

a plurality of individual rectangular carpet samples, removably deposited two to a cell, in each of a plurality of cells in said display space, each sample extending throughout substantially a complementary half of the full width of and throughout substantially the full height of the respective cell and projecting upwardly substantially thereabove.

15. The carpet sample display case of claim 1, further including:

a pedestal of substantial height;

said body being supported upon said pedestal.

16. The carpet sample display case of claim 15, wherein:

said pedestal is constituted by:

a body that is substantially rectangular in plan, and includes four upstanding walls arranged in two opposed pairs consisting of a pair of opposed side walls, and a front wall paired with a back wall, that define an upwardly open display space among them; said walls having an upper edge extending perimetrically of the body;

a rectangular rim of reinforcing material mounted upon said upper edge and extending perimetrically of the body;

means securing said reinforcing rim in place upon said upper edge;

a plurality of substantially parallel partitions arranged in a front-to-back series in said display space so as to, with said upstanding walls, divide said space into a front-to-back series of upwardly open compartments, each for receiving at least one carpet sample for projection upwardly therefrom for more casual inspection and for free withdrawal by upward sliding from the respective compartment for more particular inspection; and means securing each partition in place with respect to the body;

a second rectangular rim of reinforcing material mounted upon said lower edge and extending perimetrically of the body; and means securing said second reinforcing rim in place upon said lower edge;

this pedestal being turned on one said side wall thereof so that it rests upon said one side wall and upon both said reinforcing rims thereof; and wherein the first-mentioned said body rests upon the other side wall of said pedestal and upon both said reinforcing rims of said pedestal.

17. The carpet sample display case of claim 15, wherein:

said pedestal is constituted by a simple, vertical axis cruciform support.

* * * * *